US005859576A

United States Patent [19]

Winandy

[11] Patent Number: 5,859,576

[45] Date of Patent: Jan. 12, 1999

[54] EXTENDED SPRING LOADED TUNER

[75] Inventor: Peter M. Winandy, Elgin, Ill.

[73] Assignee: Illinois Superconductor Corporation, Mt. Prospect, Ill.

[21] Appl. No.: 624,075

[22] Filed: Mar. 29, 1996

[51] Int. Cl.[6] ..... H01P 7/06

[52] U.S. Cl. ..... 333/232; 333/235

[58] Field of Search ..... 333/231, 232, 333/233, 235, 995

[56] References Cited

U.S. PATENT DOCUMENTS

| | | | |
|---|---|---|---|
| 2,453,716 | 11/1948 | Llewellyn | 333/232 |
| 2,471,419 | 5/1949 | Edson et al. | 333/233 |
| 3,311,839 | 3/1967 | Rutulis | 333/232 X |
| 3,444,486 | 5/1969 | Banes et al. | 333/232 |
| 4,178,562 | 12/1979 | Torma et al. | 331/84 |
| 4,297,190 | 10/1981 | Garrett | 204/192.34 |
| 4,363,000 | 12/1982 | Aurand | 330/56 |
| 4,400,650 | 8/1983 | Giebler, Jr. | 315/5.41 |
| 4,426,628 | 1/1984 | Malecki et al. | 331/96 |
| 4,484,162 | 11/1984 | Kamada et al. | 333/219.1 |
| 4,521,746 | 6/1985 | Hwan et al. | 331/96 |
| 4,540,955 | 9/1985 | Fiedziuszko | 331/107 DP |
| 4,565,979 | 1/1986 | Fiedziuszko | 331/117 D |
| 4,609,883 | 9/1986 | Mizumura et al. | 331/96 |
| 4,618,836 | 10/1986 | Gannon et al. | 331/96 |
| 4,642,523 | 2/1987 | Nakanishi et al. | 315/111.81 |
| 4,682,125 | 7/1987 | Harrison et al. | 333/12 |
| 4,705,931 | 11/1987 | Di Mino | 219/68 |
| 4,766,398 | 8/1988 | Kiedrowski | 331/96 |
| 4,769,620 | 9/1988 | Nicotra | 331/96 |
| 4,775,847 | 10/1988 | Epsom et al. | 333/226 |
| 4,794,340 | 12/1988 | Ogasawara | 315/554 X |
| 4,867,398 | 9/1989 | Butcher et al. | 248/27.3 |
| 5,055,651 | 10/1991 | Schneider et al. | 333/248 X |
| 5,204,975 | 4/1993 | Shigemori | 455/231 |
| 5,343,176 | 8/1994 | Hasler | 333/204 |
| 5,365,192 | 11/1994 | Wagner et al. | 533/2.52 |
| 5,391,593 | 2/1995 | Higaki et al. | 333/235 |
| 5,420,596 | 5/1995 | Burrell et al. | 393/700 MS |
| 5,422,813 | 6/1995 | Schuchman et al. | 369/449 |
| 5,422,816 | 6/1995 | Sprague et al. | 364/449 |

FOREIGN PATENT DOCUMENTS

| | | | |
|---|---|---|---|
| 461790 | 12/1949 | Canada | 333/233 |
| 2105359 | 2/1972 | Germany | 333/233 |
| 409319 | 8/1974 | Russian Federation | 333/232 |

*Primary Examiner*—Seungsook Ham

*Attorney, Agent, or Firm*—Michael D. Rechtin; Foley & Lardner

[57] ABSTRACT

A tuner including a shaft extendible through an aperture extending completely through a jacket of the tuner. The tuner includes a shaft tensioning and grounding structure and a tuning material holder comprising a cup-shaped structure with a clasping element.

17 Claims, 2 Drawing Sheets

EXTENDED SPRING LOADED TUNER

BACKGROUND OF THE INVENTION

The present invention relates generally to tuning devices for electronic circuits. More particularly, the present invention relates to mechanically biased tuning devices providing enhanced electrical grounding and variable tuning material for different tuning requirements.

Radio Frequency ("RF") devices often require precise control or "tuning" of natural resonance of one or more resonators. Tuning is usually accomplished by disrupting natural field patterns in the resonator housing, typically by introducing a foreign object into a high field region. It has been discovered that optimal tuning for a variety of RF devices requires a variety of foreign objects disposed in a wide linear range of locations.

It is therefore an object of the invention to provide an improved tuning apparatus and method.

It is another object of the invention to provide a novel tuning apparatus and method including a tuning element having a long path of travel.

It is yet another object of the invention to provide a novel tuning device with enhanced grounding characteristics.

It is a further object of the invention to provide an improved tuning apparatus and method that provides precise adjustability over a wide range and allows use and easy replacement of a wide variety of tuner device materials.

Other objects, features and advantages of the present invention will be apparent from the following description of the preferred embodiments thereof, taken in conjunction with the accompanying drawings described below wherein like components have like numerals throughout the several views.

SUMMARY OF THE INVENTION

A particular feature of the invention is concerned with a tuner device mounted adjacent an RF resonator which is to be tuned. The tuner is positioned such that a tuner shaft is constructed with at least a portion being of an electrically conductive material which is disposed within a cavity of the RF resonator. The tuner shaft has a tuning material holder designed to hold a tuning material. The tuner further includes a shaft tensioning device disposed adjacent the tuner shaft, and the tensioning device applies a force to the threads to maintain a position of the tuner shaft. The shaft tensioning device further includes a structure for maintaining electrical grounding from the tuner shaft electrically conductive material to the shaft tensioning device.

DETAILED DESCRIPTION OF PREFERRED EMBODIMENTS

Figure 1:
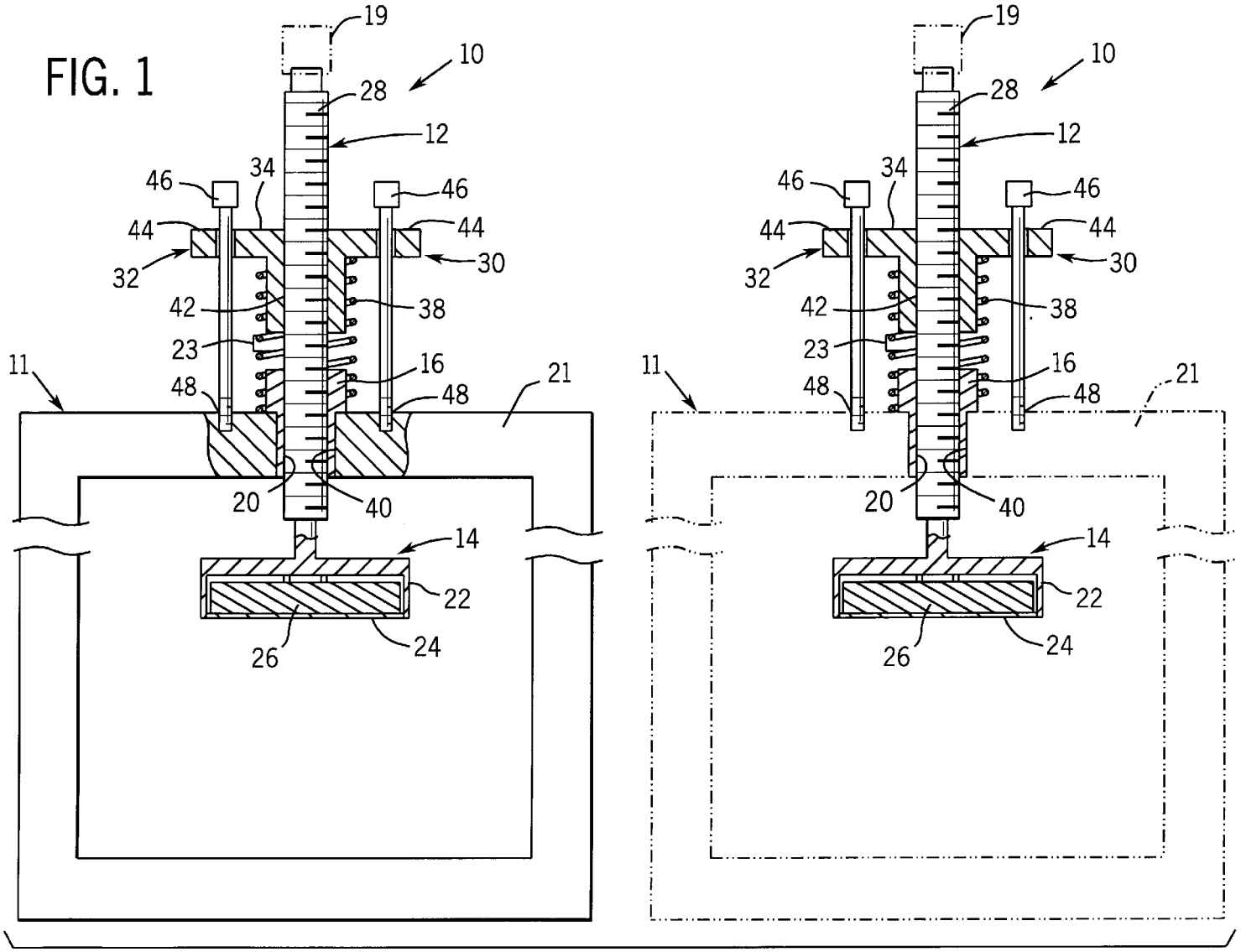
FIG. 1 illustrates a partial section view of a tuning device constructed in accordance with one form of the invention.
Figure 2:
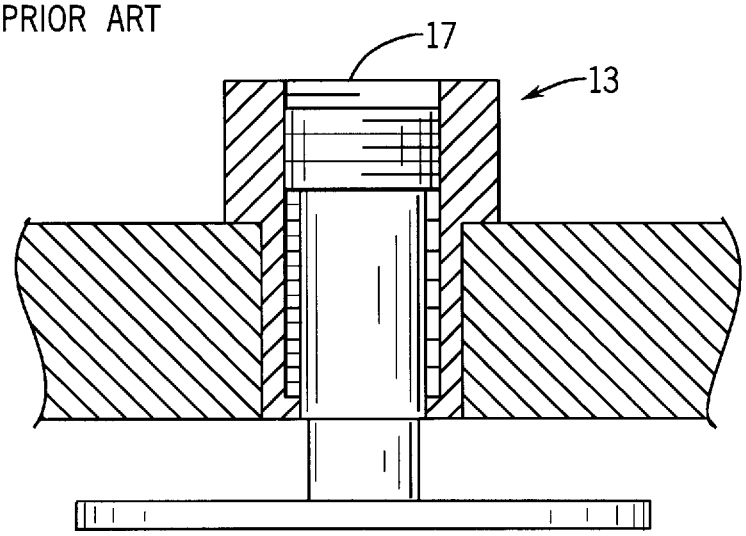
FIG. 2 PRIOR ART
FIG. 2 shows a prior art tuning device.

FIG. 1 illustrates a tuner 10 constructed in accordance with one form of the invention. The tuner 10 is preferably disposed at a location having a high magnetic field intensity in a resonator 11 (which can include more than one, such as the partial view in phantom of the second resonator 11). The tuner 10 is preferably mounted on or adjacent the resonator 11. The tuner 10 preferably includes a shaft 12 connected to a tuning material holder 14, a tuner jacket 16 disposed adjacent the shaft 12, and a thread tensioning device 30. In one preferred environment of the invention, the shaft 12 is continuously threaded and is inserted into an aperture 20 in the jacket 16 and housing 21 of the resonator 11. The aperture 20 extends completely through the jacket 16, enabling the shaft 12 and tuning material holder 14 to be adjusted over a much greater range than possible with conventional tuners. As best shown in FIG. 2, the distance of travel of the tuning material and shaft in a prior art device 13 is limited by the closed end of a tuner jacket 17 in such conventional tuners.

The shaft 12 is preferably electrically conductive and comprises a durable material, such as brass or the like. The tuning material holder 14 can take a variety of forms, however, preferably a substantially cup-shaped structure 22 is used. The cup-shaped structure 22 can include a clasping device 24, whereby a tuning material 26 can be easily inserted, removed and/or replaced. The clasping device 24 can comprise spring-loaded clips or similar biasing means, or can comprise a cap structure conventionally mechanically engageable with the cup-shaped structure 22. A wide variety of tuning materials, including combinations of conductive, nonconductive, lossy and other variable levels of lossy tuning materials 26 can be used effectively in this embodiment.

Threads 28 on the shaft 12 can be formed to keep cross tension on the threads 28. However, in accordance with one highly preferred embodiment of the invention, the external thread tensioning device 30, including a grounding structure 32 for electrically grounding the shaft 12, is used and is shown in FIG. 1. The thread tensioning device 30 preferably comprises a metal (e.g., brass) flange 34 electrically coupled to both the shaft 12 and the housing 21 of the resonator 11. The flange 34 is biased upward by a spring 38. The thread tensioning device 30 also stabilizes the relatively long shaft 12, preventing bending or other damage that can impede performance of the tuner 10.

A preferred construction method for one embodiment of the invention includes the following steps:

The tuning material holder 14 is conventionally connected to one end of the continuously threaded shaft 12. Alternatively, the tuning material holder 14 and the shaft 12 can be cast, machined or molded from a single piece of material. A housing aperture 40 is provided in the wall of the housing 21 and is dimensioned to receive a portion of the jacket 16. The jacket 16 is conventionally secured in the housing aperture 40 by a threaded section, a press fit, adhesives or the like. It is, however, important to maintain a good ohmic contact between the jacket 16 and the housing 21 regardless of the means of securing the jacket 16 in the aperture 40. The spring 38 is then placed over the exterior of the jacket 16 to complete the assembly.

The flange 34 includes an upper passageway 42 that is preferably threaded for engagement with the shaft 12. Exterior portions 44 of the flange 34 are drilled to allow insertion of screws 46 that thread into holes 48 in the housing 21. The screws 46 retain the flange in position axially and radially, preventing rotation of the flange 34 when the shaft 12 is rotated.

In accordance with another preferred embodiment of the invention as also shown in FIG. 1, the shaft 12 can be operated by a remotely controlled motor 19, or can be modified for linear motion with bellows 23 replacing the spring loaded thread tensioning device 30. Additionally, alternate tuning materials such as a semiconductor, an ionic material, a dielectric and/or high temperature superconductors can be used as the tuning material 26 in the clasping device 24, greatly increasing performance in many applications over the standard metallic paddle used the in prior art tuners 13.

A tuner 10 constructed in accordance with the present invention can completely detune the resonator 11, allowing the neighboring resonators 11 to be tuned without affecting the detuned resonator 11. Furthermore, excellent electrical grounding is maintained between the shaft 12 and the resonator housing 21 by the thread tensioning device 30, greatly increasing resonator 11 stability in many applications. Finally, varying tuning materials extending into the resonator 11 can provide less lossy tuning in specific applications.

While preferred embodiments of the invention have been shown and described, it will be clear to those skilled in the art that various changes and modifications can be made without departing from the invention in its broader aspects as set forth in the claims provided hereinafter.

What is claimed is:

1. A tuner mounted adjacent an RF resonator to be tuned, comprising:

a tuner shaft comprising an electrically conductive solid rod disposed within a cavity of the RF resonator and having threads and coupled to a holder for a tuning material;

a jacket disposed adjacent said shaft; and a shaft tensioning device disposed adjacent said shaft and separate from said jacket, said shaft tensioning device having means for applying a force to said threads to maintain a position of said shaft and also including grounding structure for maintaining electrical grounding from the electrically conductive solid rod of said tuner shaft to said shaft tensioning device.

2. The tuner as defined in claim 1, wherein said shaft is inserted into an aperture in said jacket, said aperture extending completely through said jacket.

3. The tuner as defined in claim 1, wherein said shaft is continuously threaded.

4. The tuner as defined in claim 1, wherein said tuning material holder comprises a substantially cup-shaped structure.

5. The tuner as defined in claim 4, wherein said substantially cup-shaped structure comprises a clasping device for retaining said tuning material.

6. The tuner as defined in claim 1, wherein said shaft comprises a brass material.

7. The tuner as defined in claim 1, wherein said grounding structure comprises a flange electrically coupled both to said shaft and a housing of the RF resonator to be tuned.

8. The tuner as defined in claim 1, wherein said grounding structure mechanically stabilizes said shaft.

9. A tuner for an RF resonator having a housing with an exterior surface, comprising:

a continuously threaded tuner shaft including an electrically conductive portion extending continuously from the housing exterior surface into a cavity of said RF resonator and threadably engaging both a spring-loaded flange for applying force constantly to said threaded tuner shaft and also a jacket connected to a resonator housing;

a substantially cup-shaped turning material holder coupled to said tuner shaft and including a clasping device, said tuning material holder disposed within said resonator housing; and screws coupled to said flange and said resonator housing, thereby preventing radial and rotating displacement of said flange.

10. The tuner as defined in claim 9, wherein said shaft is inserted into an aperture in said jacket, said aperture extending completely through said jacket.

11. The tuner as defined in claim 9, wherein said shaft comprises a brass material.

12. The tuner as defined in claim 9, further including a tuner material selectably disposed in said material holder.

13. The tuner as defined in claim 12, wherein said tuner material is selected from the group consisting of a metal, a semiconductor, a high temperature superconductor and an ionic material.

14. A tuner system comprising, a plurality of resonators with each of the resonators having a cavity and with each of said resonators also having an individual tuner, each said individual tuner associated with a separate resonator detunable by said tuner associated therewith thereby enabling separate tuning of each of said separate resonators; and a respective tuner shaft comprised of an electrically conductive material coupled to a corresponding resonator housing of each said separate resonator with each said respective tuner shaft of electronically conductive material extending into the cavity of the resonator and means respectively coupled to said corresponding tuner shaft for applying a respective force to said corresponding tuner shaft to maintain good electrical grounding of said respective tuner shaft of electrically conductive material to said means for applying a respective force, in each of said separate resonators.

15. The tuner as defined in claim 9 wherein said spring loaded flange acts as a tensioning device to affirmatively stabilize said continuously threaded shaft.

16. The tuner as defined in claim 15 wherein said tensioning device comprises at least one of a spring and a bellows.

17. The tuner as defined in claim 1 further including a different tuning material coupled to said electrically conductive material of said tuner shaft, said different tuning material selected from the group consisting of an electrically conductive metal different than said tuner shaft, a semiconductor, a high temperature superconductor and an ionic material.

* * * * *